US006302340B1

(12) United States Patent
Morton

(10) Patent No.: US 6,302,340 B1
(45) Date of Patent: Oct. 16, 2001

(54) POST ELECTRICAL PLUG ASSEMBLY

(75) Inventor: Greg R. Morton, Yorktown, VA (US)

(73) Assignee: Siemans Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/312,166

(22) Filed: May 14, 1999

(51) Int. Cl.[7] ..... B05B 1/30

(52) U.S. Cl. ..... 239/585.1; 239/585.4; 239/585.5

(58) Field of Search ..... 239/585.1–585.5; 439/34, 37; 29/878, 879, 860, 857

(56) References Cited

U.S. PATENT DOCUMENTS 3,566,465 * 3/1971 Weiner ..... 29/860
3,731,881 * 5/1973 Dixon et al. ..... 239/585.3
5,025,554 * 6/1991 Dohi ..... 29/860
5,157,967 * 10/1992 Wieczorek ..... 73/119
5,562,477 * 10/1996 Moore et al. ..... 439/383
5,775,599 * 7/1998 Smith et al. ..... 239/585.4 X
5,915,626 * 6/1999 Awarzamani et al. ..... 239/585.1 X
5,927,613 * 7/1999 Koyanagi et al. ..... 239/585.1

FOREIGN PATENT DOCUMENTS

2044986 * 10/1980 (GB) .

* cited by examiner

*Primary Examiner*—David A. Scherbel
*Assistant Examiner*—Dinh Q. Nguyen

(57) ABSTRACT

A fuel injector assembly comprises a fuel injector having an inlet end and an outlet end and a valve seat assembly for controlling passage of fuel through the fuel injector between the inlet end and the outlet end. Electrical terminals allow for electrical current flow through the fuel injector. A post electrical plug assembly encompassing the electrical terminals allows for connection to a mating connector, via which the injector is operated from an electronic engine control. The post electrical plug assembly is configured to accommodate multiple fuel injector geometries, and comprises an electrical plug portion, a stepped base geometry for receiving and orienting the electrical plug portion, and a weld bead for providing a leak-tight connection for the electrical plug portion.

22 Claims, 4 Drawing Sheets

POST ELECTRICAL PLUG ASSEMBLY

FIELD OF THE INVENTION

This invention relates generally to fuel injectors of the type that are used to inject fuel into the induction system of an internal combustion engine, and particularly to a molded electrical plug for attachment on such a fuel injector after assembly and testing.

BACKGROUND OF THE INVENTION

Currently, fuel injectors are molded in several lengths, and multiple electrical plug designs are required. For each injector length, for example, there may be as many as five different connector or plug designs. Each different plug design requires re-molding of the entire injector assembly, to incorporate the various plug designs. This not only costs excess dollars in extra molding tools, but also in electrical contact tooling.

Furthermore, each different plug design must be assembled and tested individually, requiring much changeover time being spent in both assembly and test areas of production. The multitude of connector or plug designs results in a statistical exercise of great magnitude, to properly assemble and test each separate design.

It is seen then that there exists a need for a standardized molded fuel injector geometry which comprises a standard post electrical plug assembly, capable of receiving multiple lengths and designs of plugs, which can be installed after assembly and testing of the standard fuel injector.

SUMMARY OF THE INVENTION

This need is met by the post electrical plug assembly of the present invention, wherein any of a multitude of different electrical plug or cover designs can be ultrasonically welded in place on a standardized molded fuel injector geometry after final assembly or test processes are passed. This eliminates re-molding of the entire injector assembly to accommodate each different plug design. The post electrical plug assembly of the present invention allows for reduced process or equipment investment and a standard product geometry for the molded injector.

In accordance with one embodiment of the present invention, a fuel injector assembly comprises a fuel injector having an inlet end and an outlet end and a valve seat assembly for controlling passage of fuel through the fuel injector between the inlet end and the outlet end. Electrical terminals allow for electrical current flow through the fuel injector. Rather than mold the electrical connector with the fuel injector assembly, the present invention proposes installing a post electrical plug encompassing the electrical terminals, after final assembly or test processes are passed. The post electrical plug allows for connection to a mating connector, via which the injector is operated from an electronic engine control. The post electrical plug of the present invention is configured to accommodate multiple fuel injector geometries. The post electrical plug is part of an assembly further comprising a stepped base geometry for receiving and orienting the plug, and a weld bead for providing a leak-tight connection for the plug.

It is an advantage of the present invention that a single mold design is provided for each injector length, with the standardized fuel injector geometry of the present invention being capable of accommodating multiple plug designs, thereby lowering labor and tooling costs.

For a full understanding of the nature and objects of the present invention, reference may be had to the following detailed description taken in conjunction with the accompanying drawings and the appended claims.

DESCRIPTION OF THE PREFERRED EMBODIMENT

Figure 1:
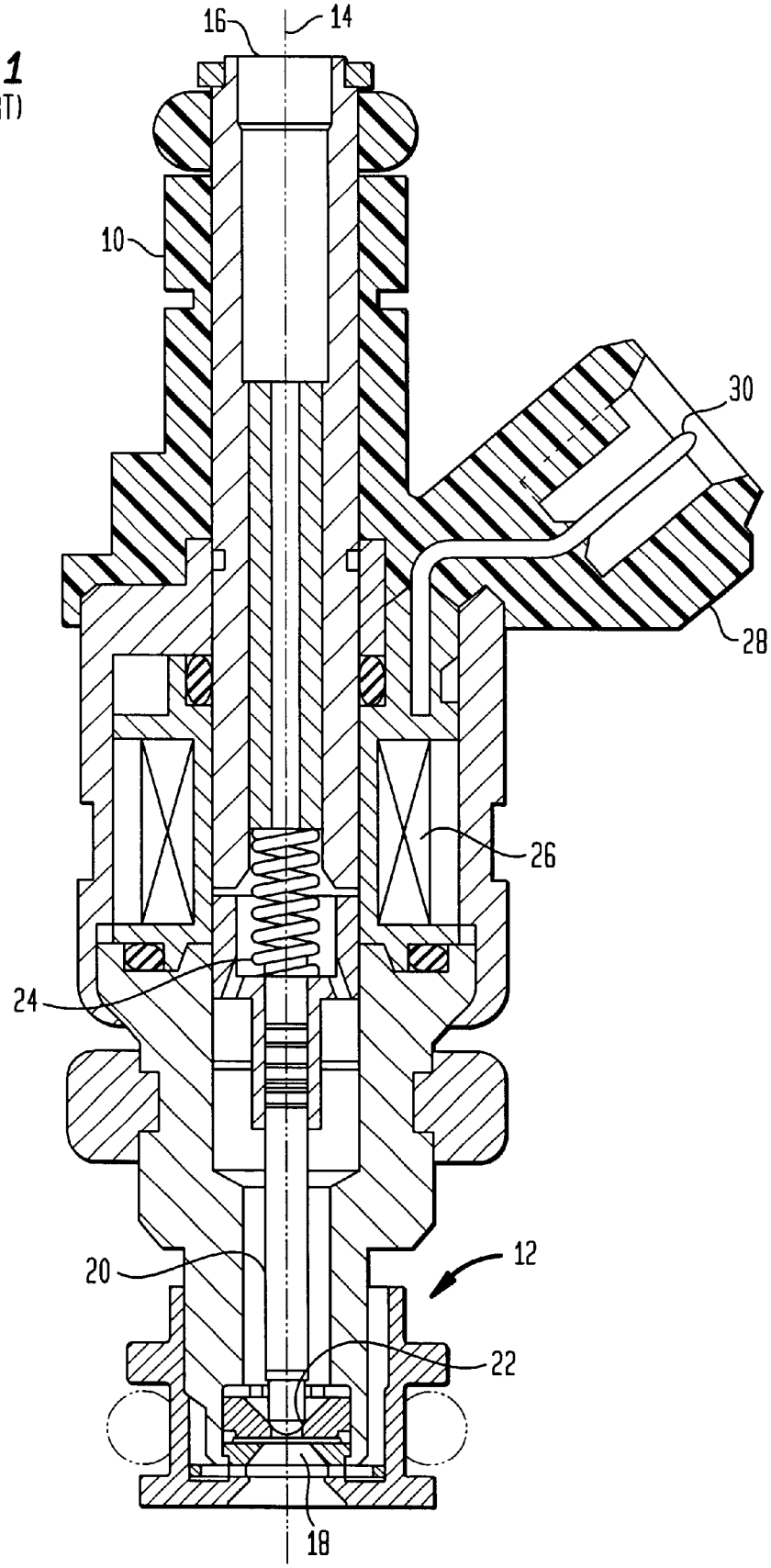
FIG. 1 (PRIOR ART)
FIG. 1 illustrates a common molded fuel injector geometry, with an electrical plug shown molded integrally with the injector.

Referring now to FIG. 1, there is shown, for purposes of description only, a typical molded electrically operated fuel injector 10, which can contain an air assist atomizer 12. Fuel injector 10, shown closed, has a main longitudinal axis 14 and is a top-feed type device comprising an inlet 16 and a nozzle 18 at its opposite axial ends. Fuel passing through the fuel injector is typically liquid fuel, but may be any fuel including, for example, gas or other fuel. The passage of fuel through the fuel injector between inlet 16 and nozzle 18 is controlled by the seating and unseating of the rounded tip end of a metal needle 20 on and from a valve seat 22 located just interior of nozzle 18. Needle 20 is resiliently biased by a spring 24 to seat on seat 22, thereby closing the passage to flow. When the valve is electrically energized by the delivery of electric energizing current to its solenoid coil 26, the needle unseats to allow fuel flow. An electrical connector 28, cutaway to illustrate an encompassed electrical terminals 30, is accessible for connection to a mating connector of, for example, a wiring harness, via which the injector's solenoid is operated from an electronic engine control. In the existing art, the connector 28 is molded with the injector 10. Therefore, each of the multiple connector geometries in the existing art require that the entire injector be molded to accommodate each variation in connector 28.

Figure 2:
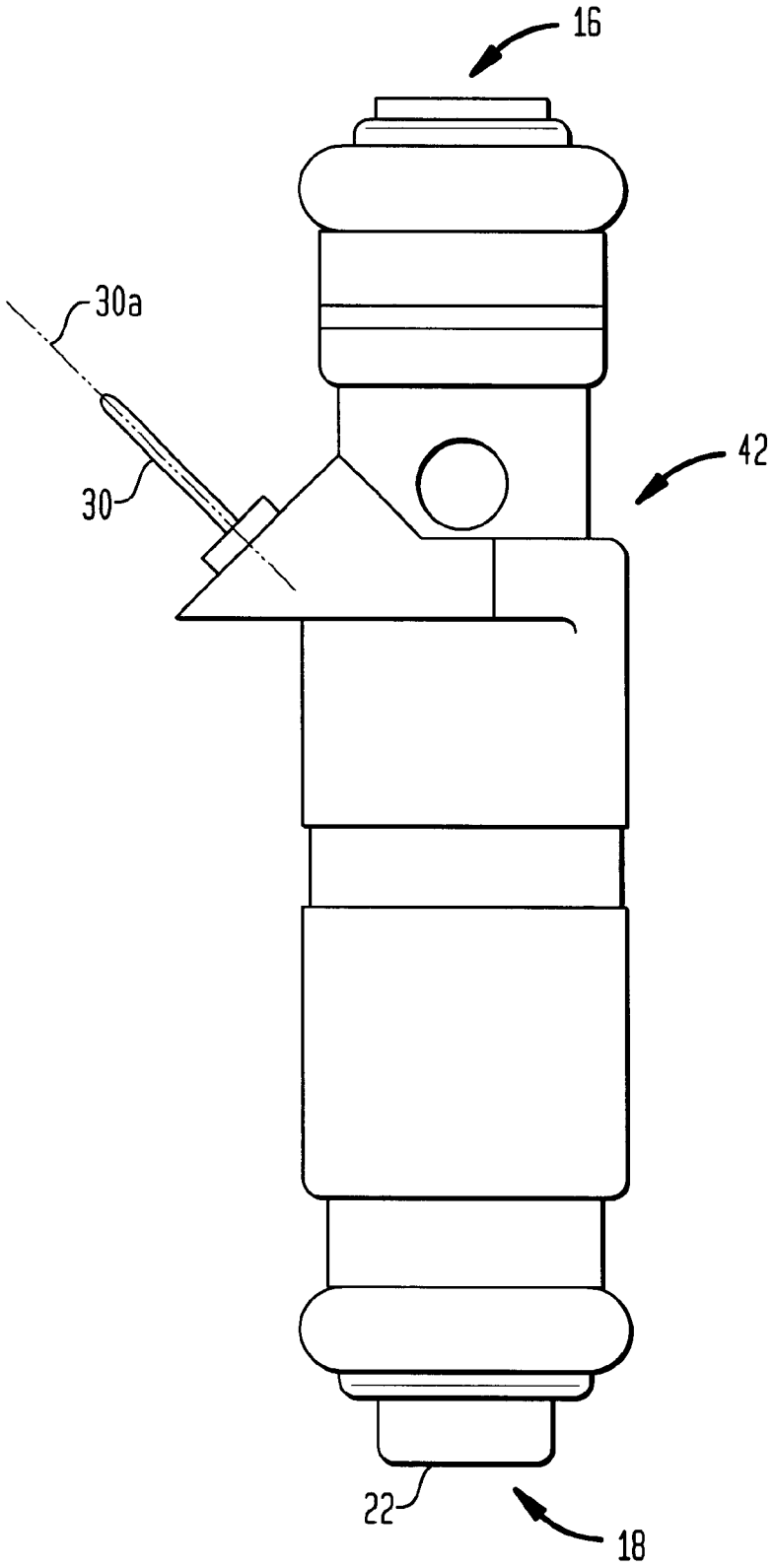
FIG. 2 illustrates a standardized molded fuel injector geometry, according to the present invention, wherein the electrical post receives any of a multitude of plug configurations after final assembly and test processes are passed.
Figure 3:
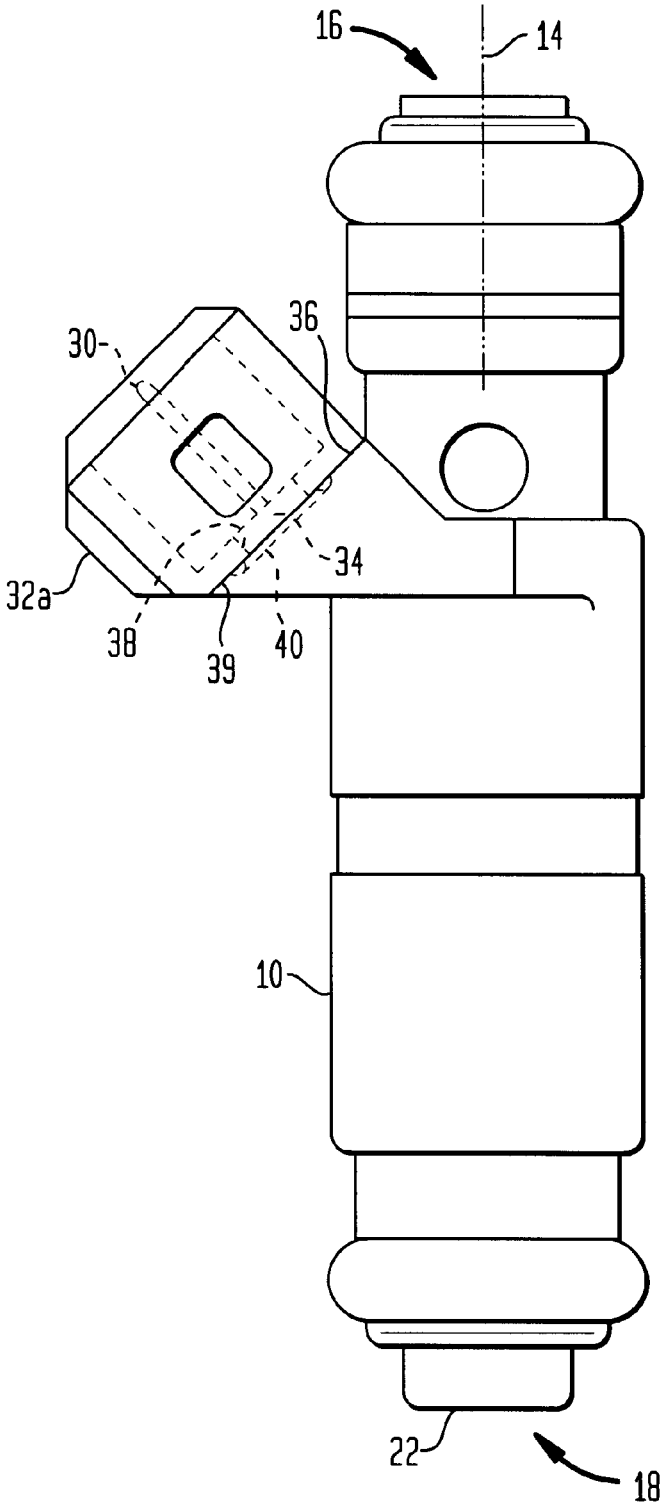
FIG. 3 illustrates the standardized molded fuel injector geometry, after assembly and test processes are passed, with one embodiment of a plug installed thereon.

In accordance with the present invention, and referring now to FIG. 2, a standardized molded fuel injector geometry 42 is proposed, wherein the plug portion is installed separately, rather than integrally molded with the injector as shown by 28 in FIG. 1. The terminal 30, therefore, does not receive a cover until assembly and testing processes are completed. Once the assembly and testing processes are passed, the electrical plug or cover 32*a* for the electrical post 30 is ultrasonically welded in place, as illustrated by FIG. 3. For any given fuel injector length and plug angle, the present invention provides for a single mold tool with a single mold color having interchangeable plug slides to accommodate different terminal or post 30 geometries. Hence, multiple batches of a single molded fuel injector geometry 42 can be generated, assembled, and tested, without requiring re-molding and testing of the entire injector assembly to accommodate various plug designs.

In a preferred embodiment of the invention, the terminal posts 30, which extend along a terminal axis 30*a,* would be greater than 50% exposed. A rectangular, square or circular stepped base 34 provides strength, support, and orientation. The stepped base geometry receives and orients the post electrical plug 32*a,* and allows for a weld attachment to the post electrical plug. The weld attachment can provide permanent ultrasonic weld of the post electrical plug 32*a,* after assembly and test processing. A lower shelf or surface 36 of the stepped base 34 is preferably approximately flat to accept the radiused weld bead 40 on the separate electrical plug 32*a.*

Figure 4A:
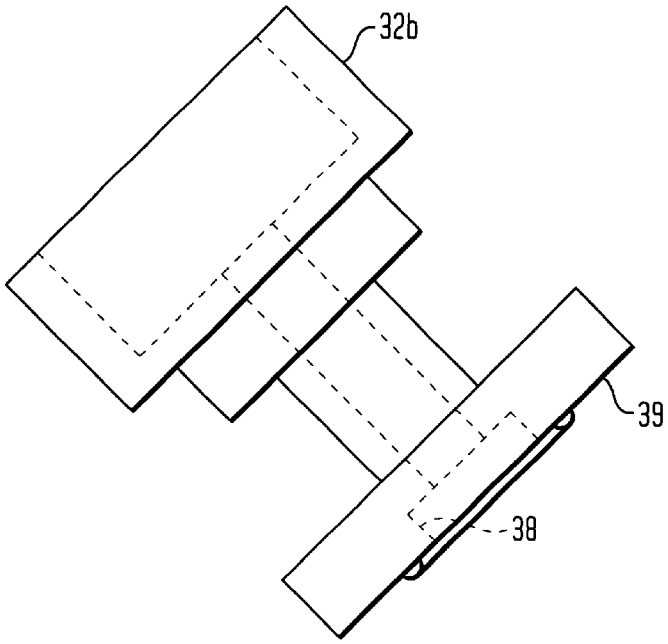
FIGS. 4A through 4C are exemplary alternative embodiments for the post electrical plug assembly, capable of installation on the standardized fuel injector of FIG. 2.
Figure 4B:
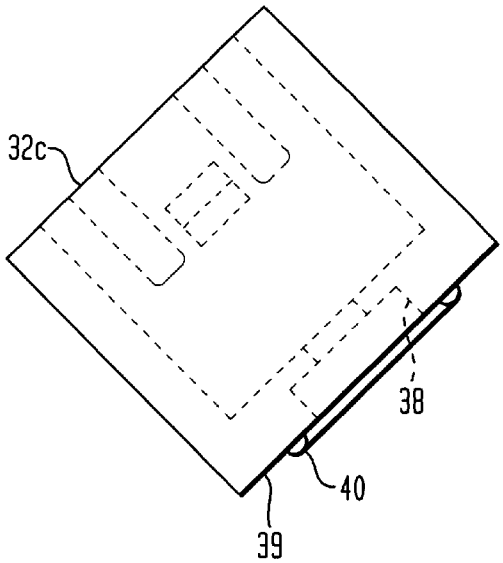
Figure 4C:
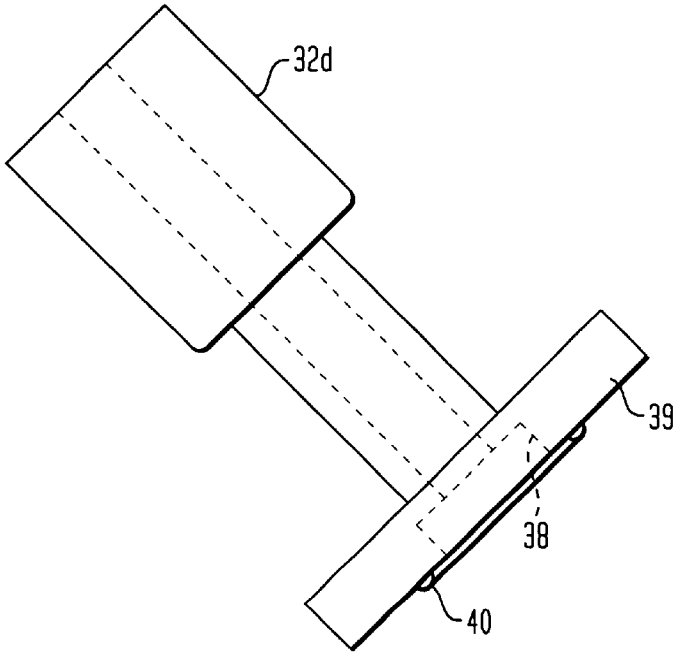

Continuing with FIG. 3, the molded electrical plug 32*a* has an opening 38 in a bottom surface 39 that mates with the stepped base 34 contour. A radiused weld bead 40 can be molded into the bottom of the plug 32*a* to add weldability and to provide a leak-tight seal. The assembly process can be any suitable process, such as a feeding position, a load-and-press position, an ultrasonic welding position and leak test. The radiused weld bead and step base geometries would be designed to fit multiple plugs, such as, for example, plugs 32*b,* 32*c,* and 32*d,* of FIGS. 4A–4C, to reduce changeover requirements. For example, in FIG. 3 and FIG. 4B, the plug comprises a single main circular diameter or square perimeter. Alternatively, in FIGS. 4A and 4C, the plug comprises multiple and varying perimeters or diameters along its length. Still other embodiments can vary the height and/or width of the plug. Those skilled in the art will recognize that multiple plug configurations can be proposed, beyond what is actually illustrated herein, without departing from the scope of the invention. Furthermore, the post electrical plug can be molded in a variety of colors and styles for product identification and to fit electrical connection needs, without departing from the scope of the invention, which allows for multiple plug designs to fit singular molded fuel injector lengths.

Those skilled in the art will now be able to recognize multiple advantages to be realized from the post electrical plug geometry proposed by the present invention. For example, the single mold design for each injector length will lower mold tool costs. Furthermore, different terminal/plug geometries using full contact probes no longer require additional assembly or test changeovers, thereby reducing labor and tooling costs. The plug configured in accordance with the present invention can now identify product type by color and geometry, thereby standardizing injector body color and reducing color identification material cost. The present invention also allows for optional assembly at the end of the assembly line on finished goods, and optional weld of complete wire assembly or cover for terminal extensions.

Having described the invention in detail and by reference to the preferred embodiment thereof, it will be apparent that other modifications and variations are possible without departing from the scope of the invention defined in the appended claims.

What is claimed is:

1. A fuel injector assembly comprising:

a fuel injector having an inlet end and an outlet end;

a valve seat assembly controlling passage of fuel through the fuel injector between the inlet end and the outlet end;

electrical terminals projecting from the fuel injector along a terminal axis, the electric terminals connecting the fuel injector to an electrical current flow; and a post electrical plug slidably receiving the electrical terminals, the post electrical plug being preformed to correspond to one of multiple fuel injector geometries.

2. A fuel injector assembly as claimed in claim 1 wherein the fuel injector also has a stepped base orienting the post electrical plug with respect to the fuel injector.

3. A fuel injector assembly according to claim 2 wherein the post electrical plug includes an aperture matingly engaging with the stepped base.

4. A fuel injector assembly as claimed in claim 1 wherein the post electrical plug comprises a weld bead for a permanent ultrasonic weld of the post electrical plug.

5. A fuel injector assembly according to claim 1 wherein the stepped base comprises a square configuration.

6. A fuel injector assembly according to claim 1 wherein the stepped base comprises a rectangular configuration.

7. A fuel injector assembly according to claim 1 wherein the stepped base comprises a circular configuration.

8. A fuel injector assembly as claimed in claim 1 wherein the post electrical plug comprises a single main outer perimeter.

9. A fuel injector assembly as claimed in claim 1 wherein the post electrical pug comprises multiple and varying perimeters along the terminal axis.

10. A fuel injector assembly according to claim 1 wherein a longitudinal axis extends between the inlet end and the outlet end, and the terminal axis is obliquely oriented with respect to the longitudinal axis.

11. A plug assembly for a fuel injector, the plug assembly comprising:

an electrical plug portion;

a stepped base adapted for orienting the electrical plug portion with respect to the fuel injector; and a weld bead providing a substantially fluid-impermeable connection between the electrical plug portion and the fuel injector.

12. A plug assembly as claimed in claim 11 wherein the stepped base comprises a square configuration.

13. A plug assembly as claimed in claim 11 wherein the stepped base comprises a rectangular configuration.

14. A plug assembly as claimed in claim 11 wherein the stepped base comprises a circular configuration.

15. A plug assembly as claimed in claim 11 wherein the stepped base comprises a generally flat surface having a recess receiving the weld bead.

16. A plug assembly as claimed in claim 11 further comprising an aperture matingly engaging the stepped base.

17. A plug assembly as claimed in claim 11 wherein the electric plug portion comprises a single main outer perimeter.

18. A plug assembly as claimed in claim 11 wherein the electric plug portion comprises multiple and varying perimeters along a length of the plug.

19. A method of manufacturing a fuel injector, the method comprising:

providing the fuel injector with an inlet at a first end and an outlet at a second end;

providing a valve controlling passage of fuel through the fuel injector between the inlet and the outlet;

testing the fuel injector to evaluate passage of fuel through the injector; and providing the fuel injector with at least one electrical terminal projecting along a terminal axis, the at least one electrical terminal being slidingly received in any one of a plurality of electrical plugs after the testing.

20. A method as claimed in claim 19 wherein the providing the valve comprises fixing a seat assembly between the inlet and the outlet.

21. A method as claimed in claim 19, wherein the at least one electrical terminal connects the fuel injector to an electrical current flow.

22. A method as claimed in claim 19 wherein the being slidingly received in any one of a multitude of electrical plugs encompasses the at least one electrical terminal.

* * * * *